United States Patent [19]

Diebold et al.

[11] 4,037,383

[45] July 26, 1977

[54] METAL GRATING

[75] Inventors: William H. Diebold, Hudson; Adolph D. Russo, Beechwood, both of Ohio

[73] Assignee: Russo Architectural Metals, Inc., Twinsburg, Ohio

[21] Appl. No.: 723,731

[22] Filed: Sept. 16, 1976

[51] Int. Cl.[2] ..... E04C 2/42

[52] U.S. Cl. ..... 52/664; 52/177

[58] Field of Search ..... 52/660–669, 52/633, 177, 473

[56] References Cited

U.S. PATENT DOCUMENTS

| | | | |
|---|---|---|---|
| 1,606,434 | 11/1926 | McAfoos | 52/667 X |
| 2,459,983 | 1/1949 | Werner et al. | 52/473 |
| 2,607,089 | 8/1952 | Clark et al. | 52/669 X |
| 3,378,955 | 4/1968 | Wahlgren | 52/473 X |
| 3,755,988 | 9/1973 | Van Der Sluys | 52/664 |

FOREIGN PATENT DOCUMENTS

| | | | |
|---|---|---|---|
| 197,100 | 5/1923 | United Kingdom | 52/669 |

*Primary Examiner*—J. Karl Bell

*Attorney, Agent, or Firm*—Meyer, Tilberry & Body

[57] ABSTRACT

An improved metal grating employs a series of parallel bearing bars and cross bars passing laterally through longitudinally spaced holes in the bearing bars. Separate spacer members are provided for maintaining spacing between adjacent pairs of bearing bars. The spacers conform to the shape of and may positively engage a cross bar. The cross bars are fabricated having a length shorter than the total of the width of all the bearing bars and spacer members comprising the grating so that when securing means are tightened to locate the cross bars within the grating, the sides of the bearing bars are brought into compressive contact with the edges of the spacer members.

11 Claims, 6 Drawing Figures

METAL GRATING

This invention relates generally to the art of metal gratings and more specifically to metal gratings having individual spacer members disposed on the cross bars and held by compression between the bearing bars.

Metal gratings have long found application in industrial service as floor surfaces or stair tread surfaces where traction and wear resistance were necessary or where an elevated floor surface was needed for drainage space, catwalks, fire escapes or the like. Metal gratings are commonly constructed of either steel or aluminum alloy. The gratings generally comprise a series of parallel, long bearing bars of either rectangular or I-beam cross section which are interconnected at regularly spaced intervals with laterally extending cross bars. The gratings are usually designed to be supported on the ends of the bearing bars only and have a free span between the supported ends.

There are several means in the prior art for securing the cross bars to the bearing bars to provide the necessary structural rigidity and spacing of bearing bars to the completed grating. Thus, cross bars may be inserted transversely across the series of bearing bars at notches provided in the top portions of the bearing bars to receive the cross bars. Each of the cross bars is then individually welded to each of the bearing bars at their juncture transversely across the grating.

Another grating has been made by providing a series of key-hole slots in the bearing bars through which cross bars of conforming key-shaped cross-section may be inserted, the cross bars having outwardly-extending spacer portions which, when rotated following insertion through the key holes of the bearing bars, extend vertically from the cross bars to the top of the grating and serve to maintain a reasonable degree of spacing between the bearing bars. The cross bar is then usually pressure locked by flaring its ends in order to secure the cross bar in an upright position.

A third alternative common in aluminum gratings is a series of rivetted reticuline bars passing back and forth in a woven pattern between adjoining pairs of bearing bars to space them from each other. No cross bars are used in this type of grating.

There are several difficulties with gratings made in a manner such as described above. With welded cross bars, each cross bar must be individually spot welded to each individual bearng bar at its juncture with each cross bar. This involves a substantial amount of time and practically precludes the on-site assembly of a grating so that it may conform to the shape of the space in which it is to be positioned. Thus, the grating must be preassembled at a place remote from the installation site and transported to the place of use for installation. Remote assembly obviously necessitates a very accurate premeasurement of the space in which the grating is to be installed so that properly fitting gratings may be assembled. Additionally, the gratings must be transported to the installation site in a completed condition, thus occupying a substantially larger quantity of space on the transport means when compared with the volume of the non-assembled grating pieces.

With the keyhole slot type grating device, similar and additional problems arise. As with the welded grating, it is almost essential that the grating be preassembled in a remote location and transported to the installation site in substantially completed condition thus involving all of the complications discussed in conjunction with the welded gratings. In addition, the keyhole-type arrangement does not always secure the bearing bars in a tight vertical relationship. The bearing bars may be loose so they are able to wobble away from a vertical plane and a substantial amount of their load bearing capactiy may be lost thereby. In an effort to overcome this problem, it has been necessary to provide welded end plates transversely across the ends of the series of bearing bars and/or spotwelding of at least some of the bearing bars to the cross bars. This obviously involves additional expense, time and material and does not always fully correct the problems. Further, the flared end portions of the cross bars may eventually work loose through the stresses of loading and unloading the grating during normal use, thus causing a reduction in the load bearing capacity of the grating or a failure of the grating altogether.

The present invention overcomes these and other problems associated with gratings of the prior art by providing a plurality of parallel extending bearing bars through which a plurality of cross bars pass. Spacer members are provided which are of a size and shape which allows them to be snapped on and/or over the cross bars from the side intermediate adjacent pairs of bearing bars in order to properly space the individual bearing bars from each other in a parallel relationship. In order to retain the spacer members in place, the cross bar is of a length shorter than the transverse width of the completed grating so that when securing means such as a self-tapping screw is applied to the end of the cross bar adjacent the outer side of the outer bearing bar, the head of the screw acting against the outside bearing bar, the bearing bars are drawn laterally together and the spacer members are compressed therebetween to hold the spacer members in rigid spacing relationship between the individual bearing bars. In a preferred embodiment, the cross bar has notched portions for receiving corresponding catch portions of the spacer member to positively engage the spacer member with the cross bar.

Additionally, the spacer member may be provided with an upwardly extending portion which will meet the top surface of the bearing bars and provide both additional vertical and lateral support for the bearing bars and an additional tread surface of the grating. The snap-on arrangement of the spacer members and the securing of the cross member by a device such as screw means permits the easy assembly of the grating at the installation site and permits easy on-site adjustment to any irregularities in the space in which the grating is to be installed.

It is therefore an object of this invention to provide a grating which is simple in construction, and has a maximum load carrying capacity.

It is an object of this invention to provide means whereby spacer members may be snapped onto cross bars for the side to maintain the spacing between bearing bars of a metal grating, the spacer members being held in place on the cross bars by compression forces generated by securing means for the cross bar acting transversely of the grating so that the bearing bars and spacer members are held together in compression.

It is yet another object of the invention to provide a metal grating wherein cross bars are provided which are slightly shorter than the transverse width of the completed grating and spacer members are provided which nest with and positively engage the cross bar and are prevented from rotation thereby and which act to maintain the parallel spacing of the bearing bars of the grating, the spacer members being held in compression by screw means which draw the bearing bars toward each other transversely across the width of the grating along the axes of the cross bars.

These and other objects of the present invention will become apparent through a description of a preferred embodiment of the invention as set forth hereinafter.

BRIEF DESCRIPTION OF THE DRAWINGS

While the invention may take physical form in a variety of parts and arrangements of parts, a preferred embodiment of the invention is shown in various figures forming a part of this specification which are intended as being illustrative of the invention but which are not intended to in any way limit the scope of the invention.

Figure 1:
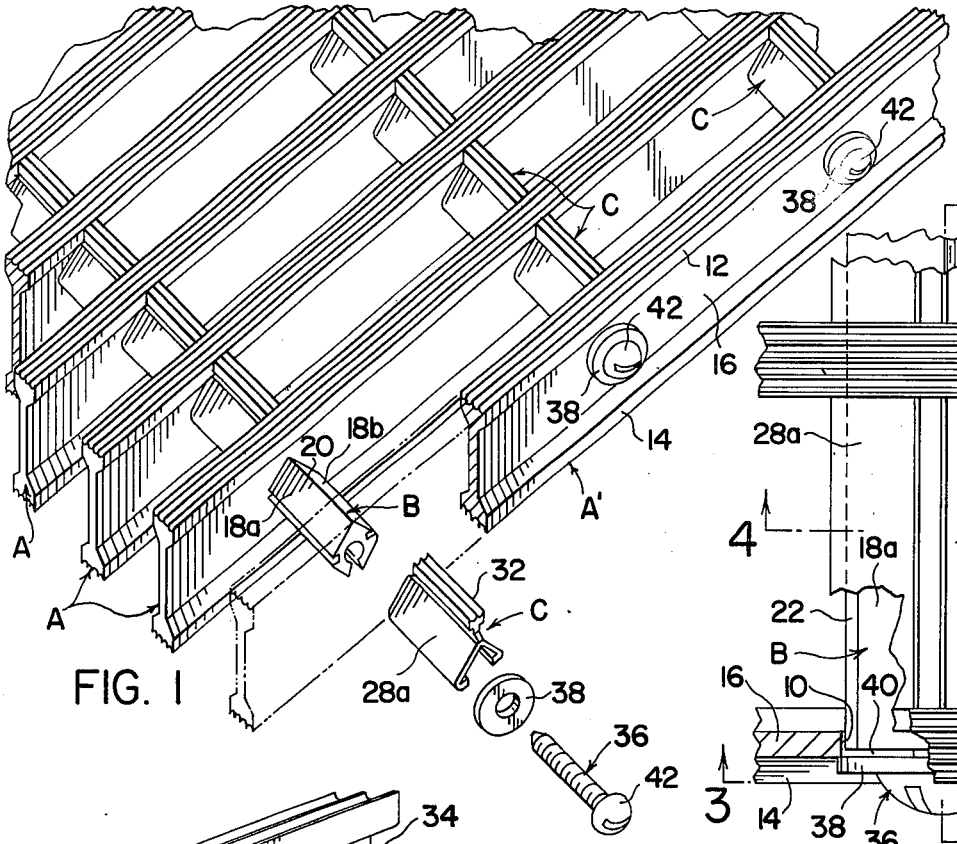
FIG. 1 is a perspective view, partially exploded and partially in section, of a portion of a grating according to a preferred embodiment of the invention.
Figure 2:
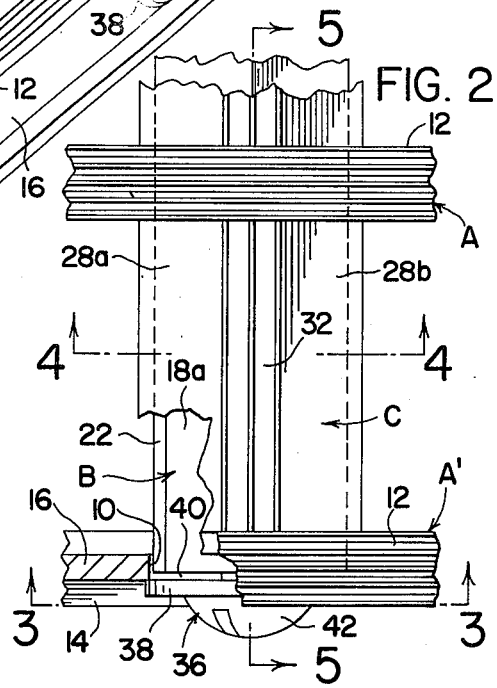
FIG. 2 is a top elevational view of a portion of the preferred grating adjacent the edge showing bearing bars and one spacer member in accordance with a preferred embodiment of the invention.

The reference numbers used to identify the various individual parts of the invention are used for that part throughout the figures. for the purposes of clarity.

As shown in the figures, the grating in accordance with the invention comprises a plurality of spaced, parallel extending bearing bars A each having a plurality of transverse openings 10 therethrough, cross bars B extending through the aligned openings 10 and spacer members C disposed on the cross bars B between adjacent pairs of bearings bars A and maintaining the parallel spacing therebetween.

Bearing bars A may take any cross-sectional form such as rectangular, L-form, T-form, square, etc., but as shown in the drawings, the preferred form of bearing bar has an I-beam cross-sectional form having top and bottom flange portions 12, 14 and an intermediate web portion 16. The upper surface of flange portions 12, 14 may be planar or, as shown, may be grooved so as to provide an increased gripping surface to the grating. The plurality of spaced transverse openings 10 permit cross bars B to pass therethrough.

Figure 3:
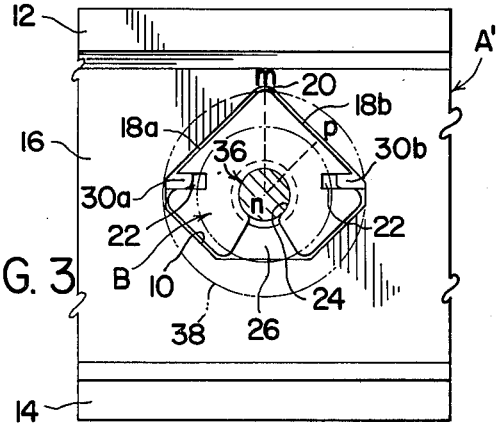
FIG. 3 is a cross-sectional view in elevation of the side of the bearing bar taken along line 3—3 of FIG. 2.

Cross bars B are of a cross-sectional shape which substantially conforms to the shape of openings 10 in bearing bars A and allows the cross bars B to pass therethrough. The shape of openings 10 and the cross section of cross bars B may take any desired form but it is preferred that the shape be such that cross bar B will be prevented from rotation within the opening 10, e. g., square, elliptical, triangular or rectangular. This opening and corresponding cross-sectional shape may be generally described as non-circular or having a form which has at least one radial dimension measured from a center point of the opening or cross-section which is greater than some other radial dimension measured from the same center point. As best shown in FIG. 3, the radial relationship is illustrated in the preferred, generally pentagonal form of opening 10 and cross bar cross-section by the radially extending lines *m–n* and *n–p,* line *m–n* being greater in length than line *n–p.* Other means for securing the cross bars against rotation such as a pin member passing through the cross bar and engaging the bearing bar may be employed.

Figure 6:
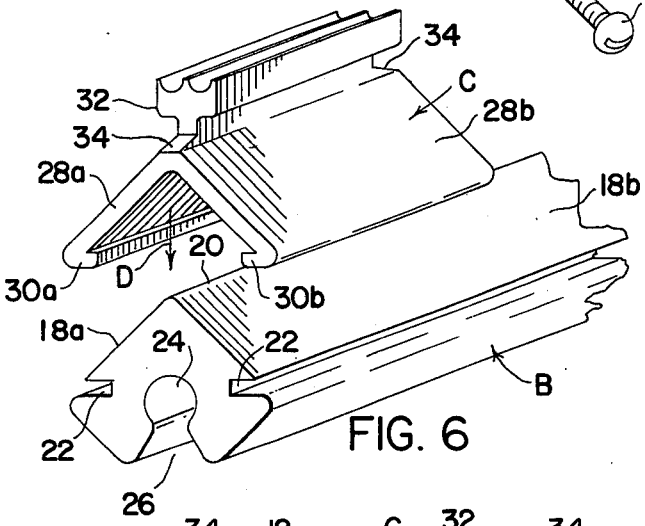
FIG. 6 is an exploded, perspective view of a preferred embodiment of a cross bar and spacer member showing the method of attachment of these pieces.
Figure 4:
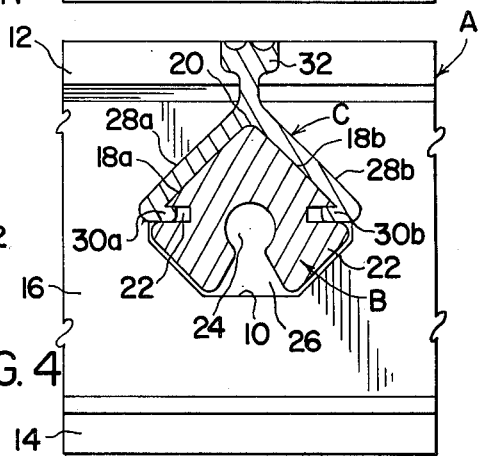
FIG. 4 is a cross-sectional view in elevation taken along line 4—4 of FIG. 2.

As best shown in FIGS. 3, 4, and 6, the preferred form cross-section of cross bar B is generally pentagonal. The cross-section has an upper mating surface which may be of any form but which in the preferred embodiment is in the form of two downwardly diverging surfaces 18*a,* 18*b* extending from a central apex 20. Longitudinally and inwardly extending notch portions 22 are provided below mating surfaces 18*a,* 18*b.* A central passage 24 is also provided for receiving fastening means to be further described below. A non-functioning portion of the cross bar B may be removed, such as in area 26 of cross bar B, to reduce the amount of metal used and permitting a consequent reduction in weight of the grating.

Each spacer member C is preferably formed in a manner that permits it to be locked in its assembled position on cross bar B and rest on the upper surface thereof. In the preferred embodiment shown in the drawings, spacer member C comprises leg portions 28*a,* 28*b* which diverge downwardly so as to mate with surfaces 18*a,* 18*b.* Leg portions 28*a,* 28*b* may merely rest on surfaces 18*a,* 18*b* or, as in the preferred embodiment are provided with inwardly extending lugs 30*a,* 30 *b* at the lowermost edges which fit into and lock in notches 22. Lugs 30*a,* 30*b* should extend inwardly at least in an amount less than the spacing of the lowermost edges of surfaces 18*a,* 18*b* but not so much that the spacer member C cannot be snapped onto the cross bar C from the side without exceeding the elastic limit of the material of which the spacer member C is made. The recitation "from the side" of the cross bar as used in this specification will be understood to mean the mounting of the spacer member in a direction such as shown by arrow D of FIG. 6, such direction being generally perpendicular to the longitudinal axis of cross bar B.

In an alternative embodiment not shown in the drawings, the spacer member may be provided with leg portions which nest with and conform to the upper mating surfaces of the cross bar and extend outwardly and downwardly to the widest point of the cross bar cross section, at which point, the legs extend inwardly and downwardly along the portions of the cross bar below the widest point so as to grip the cross bar without positively engaging same as at the notch portions provided in the preferred embodiment. It will be understood that the leg portions extend inwardly and downwardly only to a point sufficient to grip the portion of the cross bar below the widest section and so that the spacer member may be snapped onto the cross bar from the side without exceeding the elastic limit of the material comprising the spacer member.

In the preferred embodiment, spacer member C has an upwardly extending portion 32 extending from the juncture of leg portions 28*a,* 28*b.* Upwardly extending portion 32 extends vertically so that its top surface is flush with the top surface of the flanges 12 when the spacers are in position in the completed grating. As shown in the preferred embodiment, the top portion of upwardly extending portion 32 is flanged and grooved to provide additional tread surface to the completed grating. It will be understood that portion 32 may take other forms, such as rectangular or triangular, and the top surface thereof may be planar as well as grooved as shown.

Figure 5:
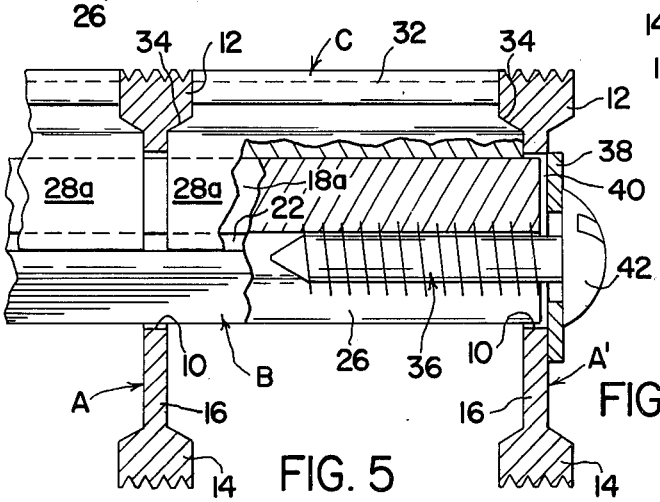
FIG. 5 is an end elevational view, partially in section, taken along line 5—5 of FIG. 2.

In the preferred embodiment employing I-beam type bearing bars A having top flange 12, the upwardly extending portion 32 of spacer member C may be notched as at shoulder 34, as shown in FIGS. 5 and 6, to conform to the shape of top flange portion 12.

In assembling the grating in accordance with the invention, a plurality of cross bars B are passed through the series openings 10 in a plurality of bearing bars A and spacer members C are snapped onto the cross bars B from the side between adjacent pairs of bearing bars A. Fastening means, such as self-tapping screw 36 is then attached to the end of cross bar B at central passage 24 and rests against washer 38 and the outer surface of outer bearing bar A'.

In accordance with the invention, cross bar B has a length which is somewhat shorter than the total of the transverse width of all of the bearing bars used in the grating and the total longitudinal length, measured parallel to the longitudinal axis of cross bar B, of all spacer members C interposed therebetween. This shorter length of cross bar B provides for a space 40 as shown in FIGS. 3 and 5 adjacent the end of cross bar B and the outer surface of outer bearing bar A'. As the fastening means, such as self-tapping screw 36, is tightened on cross bar B, the screw head 42 acts against the outer surface of the outer bearing bar A' to draw cross bar B into space 40. This places cross bar B in tension and compresses the bearing bars A and spacer members C together along the longitudinal axis of cross bars B thereby holding spacer members C rigidly in compression between bearing bars A and precluding rotation of the spacer members C around the longitudinal axis of cross bar B.

It will be understood that other fastening means for tensioning cross bar B to compress bearing bars A and spacer members C together, such as for example flaring or welding may be employed as an alternative to self-tapping screw 36.

Space 40 is preferably narrower than the transverse width of web portion 16 of bearing bar A'.

The cross bars B have been shown passing through the approximate vertical center of the bearing bars A. It will be understood that the height of the bearing bars may be varied considerably according to the desired load bearing limits and the position of the cross bars B correspondingly adjusted so that the spacer members C are properly positioned in the grating. Thus, the cross bars B may be positioned above the vertical center line of the bearing bars so that upwardly extending portion 32 of spacer members C meets the top surface of the grating. Alternatively, spacer members C may be provided with any one of several upwardly extending portions 32 of differing lengths so that the position of the cross bar may be maintained in the vertical center of the bearing bars and the upwardly extending portions 32 of the spacer members C will meet the grating surface.

While the invention has been described in relation to specific parts and arrangements of parts, other embodiments of our invention have been suggested and still other embodiments will occur to those skilled in the art. It is intended that our invention include all such embodiments limited only by the scope of the appended claims.

Having thus described our invention we claim:

1. A metal grating comprising:

a plurality of spaced parallel extending bearing bars including a pair of outer bearing bars and a plurality of intermediate bearing bars therebetween, said bearing bars having a plurality of spaced transverse openings along their length with the openings of each bearing bar being aligned with openings of an adjacent bearing bar;

a plurality of transverse cross bars each passing through respective aligned openings in said bearing bars;

a plurality of spacer members each mounted on a cross bar in the space between adjacent pairs of said bearing bars, means holding said spacer members in position on said cross bars, and fastening means acting in conjunction with said outer bearing bars and the ends of said cross bars placing said cross bars in tension and said bearing bars and said spacer members in compression.

2. The grating as described in claim 1 wherein at least some of said openings and said cross bars have a noncircular shape which precludes rotation of said cross bars within said openings.

3. The grating as described in claim 1 wherein said spacer members have leg portions which extend around a substantial portion of said cross bars.

4. The metal grating as described in claim 1 wherein each of said cross bars includes a pair of longitudinally extending notch portions disposed along said cross bars and said spacer members include a pair of outwardly extending legs having a juncture at one end thereof and a lug at the opposite end thereof which engage said notch portions to positively retain said spacer members on said cross bars, said lugs extending inwardly toward one another to define a space therebetween, said space being such that said spacer members may be snapped in place for the side of said cross bars without exceeding the elastic limit of the material comprising said spacer members.

5. The metal grating as described in claim 1 wherein said cross bars each have a length which is shorter than the combined total transverse width of said plurality of bearing bars and plurality of spacer members and said fastening means comprises a screw.

6. The metal grating as described in claim 4 wherein said fastening means comprises a screw.

7. The metal grating as described in claim 4 wherein said spacer member further includes an upwardly extending tread portion.

8. The metal grating as described in claim 1 wherein said bearing bars have an I-beam form having top and bottom flange portions and an intermediate web portion, said openings being in said web portion.

9. The metal grating as described in claim 8 wherein the ends of said spacer members have a shape to conform to said flange portions.

10. The metal grating as described in claim 4 wherein said openings and said cross bars have a generally pentagonal form, said cross bars having a pair of upper mating surfaces and said legs of said spacer members nest with said mating surfaces.

11. The metal grating as described in claim 10 wherein said spacer members have an upwardly extending portion extending from said juncture of said leg portions.

* * * * *